US009335696B2

(12) United States Patent
Haraguchi

(10) Patent No.: US 9,335,696 B2
(45) Date of Patent: May 10, 2016

(54) IMAGE FORMING APPARATUS, AND METHOD FOR CONTROLLING IMAGE FORMING APPARATUS

(71) Applicant: CANON KABUSHIKI KAISHA, Tokyo (JP)

(72) Inventor: Takahiro Haraguchi, Matsudo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/747,858

(22) Filed: Jun. 23, 2015

(65) Prior Publication Data

US 2015/0378294 A1 Dec. 31, 2015

(30) Foreign Application Priority Data

Jun. 26, 2014 (JP) ..... 2014-131142

(51) Int. Cl.
*G03G 15/00* (2006.01)

(52) U.S. Cl.
CPC ..... *G03G 15/5004* (2013.01)

(58) Field of Classification Search
CPC ..... B41J 29/17; G03G 15/5004
See application file for complete search history.

(56) References Cited

U.S. PATENT DOCUMENTS 7,218,425 B2 * 5/2007 Saida ..... H04N 1/00002 358/437
2009/0326807 A1 * 12/2009 Ramaswamy ..... H04L 67/12 701/408
2011/0280026 A1 * 11/2011 Higgins-Luthman .. B60Q 1/143 362/466
2013/0158796 A1 * 6/2013 Higgins-Luthman .. B60Q 1/143 701/36

FOREIGN PATENT DOCUMENTS

JP 06059041 A * 3/1994
JP 11234543 A * 8/1999
JP 2004344747 A * 12/2004
JP 2006062219 A * 3/2006
JP 2013-101003 A 5/2013

* cited by examiner

*Primary Examiner* — David Gray
*Assistant Examiner* — Sevan A Aydin
(74) *Attorney, Agent, or Firm* — Canon USA Inc. IP Division

(57) ABSTRACT

An image forming apparatus having a first power state and a second power state in which power consumption is lower than in the first power state includes a detection unit configured to detect an object present in a vicinity of the image forming apparatus, an receiving unit configured to receive a user's operation, a control unit configured to, if the object is detected by the detection unit or if the receiving unit receives the user's operation, shift the image forming apparatus from the second power state to the first power state, and a display unit configured to, if the image forming apparatus is shifted from the second power state to the first power state in response to receipt of the user's operation by the receiving unit, display information indicating that there is dust adhering to the detection unit.

18 Claims, 15 Drawing Sheets

ENTER DETECTION AREA
DETECTION AREA
6012
6013
6011
1000
h
H
l
α
β
h'
DETECTION RESULT OF INFRARED ARRAY SENSOR
RECOVERY AREA
THRESHOLD IN DETECTION AREA
DETERMINATION AREA

REACH POWER SAVING RECOVERY DISTANCE
DETECTION AREA
6012
6013
6011
1000
h
H
l
α
β
h'
RECOVERY AREA
DETERMINATION AREA
a b c d e f g h
1 2 3 4 5 6 7 8

IMAGE FORMING APPARATUS, AND METHOD FOR CONTROLLING IMAGE FORMING APPARATUS

BACKGROUND OF THE INVENTION

1. Field of the Invention

The present invention relates to a technique for detecting approach of a person by using a sensor, and controlling an image forming apparatus. In particular, the present invention relates to control for detecting dust near a sensor attached to the image forming apparatus.

2. Description of the Related Art

When detecting approach of a person by a sensor and controlling an image forming apparatus, it is important to maintain the sensor in an effectively functioning state. For example, if dust adheres to the sensor, the sensor may fail to function effectively. To detect dust adhering to a sensor, a sensor of light emission type conventionally is used. The sensor emits light in a predetermined detection direction, and senses the reflected light to detect the dust. Japanese Patent Application Laid-Open No. 2013-101003 further discusses a technique for determining color of light that facilitates dust detection according to the reflected light obtained by the sensor, and emitting light of that color.

An infrared array sensor of non-light emission type detects infrared rays emitted from a heat source. If such a sensor of non-light emission type is used to control the image forming apparatus, dust detection similar to that of a conventional sensor of light emission type cannot be carried out. If an infrared light receiving unit of the infrared array sensor is blocked by dust, the infrared array sensor fails to detect a heat source, in which case it may become impossible to detect the approach of a person by using the sensor and control the image forming apparatus.

SUMMARY OF THE INVENTION

The present invention is directed to a configuration that can determine whether dust is adhering, even with a sensor of non-light emission type such as an infrared array sensor.

According to an aspect of the present invention, an image forming apparatus that can enter a first power state and a second power state in which power consumption is lower than in the first power state includes a detection unit including a plurality of elements for detecting heat emitted from an object, arranged on a line or in a grid-like configuration, a first determination unit configured to determine whether to switch a power state of the image forming apparatus from the second power state to the first power state by using temperature distribution information detected by each of the elements of the detection unit, and a second determination unit configured to, if the power state of the image forming apparatus is switched from the second power state to the first power state for a reason other than a determination of the first determination unit, compare temperature distribution information obtained from the detection unit at different times and determine whether there is an object adhering to the detection unit.

Further features of the present invention will become apparent from the following description of exemplary embodiments with reference to the attached drawings.

DESCRIPTION OF THE EMBODIMENTS

Exemplary embodiments of the present invention will be described below with reference to the drawings.

Figure 1:
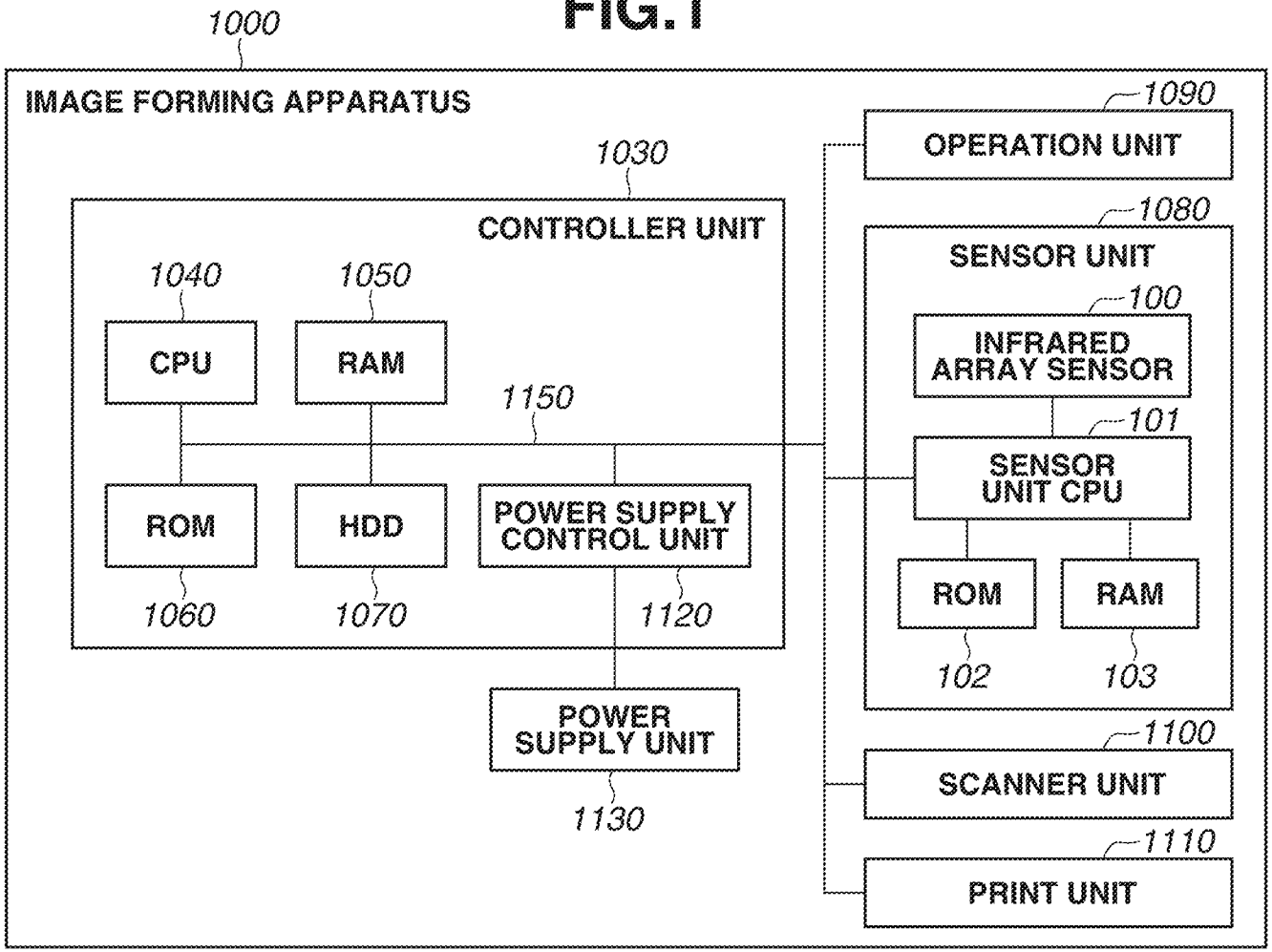
FIG. 1 is a diagram illustrating an example of a configuration of an image forming apparatus which is a first exemplary embodiment of the present invention.

FIG. 1 is a diagram illustrating an example of a configuration of an image forming apparatus which is a first exemplary embodiment of the present invention. In FIG. 1, an image forming apparatus 1000 includes a controller unit 1030, a scanner unit 1100, a print unit 1110, an operation unit 1090, a sensor unit 1080, and a power supply unit 1130.

The image forming apparatus 1000 has at least two power modes (power states). One is a normal operation power mode. Another is a power saving mode in which power consumption is lower than in the normal operation power mode. In the normal operation power mode, the image forming apparatus 1000 performs a copy operation. If a certain time has elapsed without operating the image forming apparatus 1000 in the normal operation power mode, a power supply control unit 1120 of the controller unit 1030 controls the power supply unit 1130 to shift the image forming apparatus 1000 to the power saving mode. In the power saving mode, the power supply unit 1130 stops supplying power to the scanner unit 1100 and the print unit 1110. The power supply unit 1130 further stops supplying power to some of the parts in the controller unit 1030 and unnecessary portions in the operation unit 1090. Details will be described below.

The controller unit 1030 is connected to the scanner unit 1100 which is an image input device, the print unit 1110 which is an image output device, and the operation unit 1090 for making settings of the image forming apparatus 1000 and giving instructions about an operation of the image forming apparatus 1000. The controller unit 1030 is also connected to the sensor unit 1080. The controller unit 1030 is further connected to the power supply unit 1130 which supplies power to the operation unit 1090, the scanner unit 1100, the print unit 1110, the controller unit 1030, and the sensor unit 1080. The power supply from the power supply unit 1130 to various parts is performed via the controller unit 1030.

The controller unit 1030 includes a central processing unit (CPU) 1040, a random access memory (RAM) 1050, a read-only memory (ROM) 1060, a hard disk drive (HDD) 1070, and the power supply control unit 1120. The RAM 1050 is a working memory. The ROM 1060 stores a control program for the CPU 1040. The HDD 1070 is a hard disk in which image data input from the scanner unit 1100 is temporarily stored. The controller unit 1030 may include a solid state drive (SSD). The CPU 1040 operates according to (executes) the program stored in the ROM 1060 to control the image forming apparatus 1000. The power supply control unit 1120 controls the power supply unit 1130 according to the power mode of the image forming apparatus 1000.

The print unit 1110 forms a latent image according to image data output from the controller unit 1030 and transfers the latent image to a sheet. The print unit 1110 may use different print methods such as an inkjet method. The scanner unit 1100 reads and computerizes an image printed on a sheet, and outputs resultant signals to the controller unit 1030.

The operation unit 1090 is a user interface for inputting settings of the image forming apparatus 1000 and operation instructions for the image forming apparatus 1000.

The sensor unit 1080 includes an infrared array sensor 100, a sensor unit CPU 101, a RAM 103, and a ROM 102.

The infrared array sensor 100 is a sensor for obtaining temperature distribution information about a heat source (human body). The infrared array sensor 100 is a sensor including a plurality of infrared light receiving elements arranged in an M×N grid-like configuration (M and N are natural numbers). The infrared array sensor 100 is characterized by receiving infrared rays radiated from a heat source with each one of the infrared light receiving elements arranged in the grid-like configuration, and identifying the shape of the heat source as temperature distribution information by using temperature values detected by the respective infrared light receiving elements. Using such a characteristic, the image forming apparatus 1000 detects temperature of an approaching heat source, determines from the shape and temperature of the heat source whether the heat source is a person, and controls recovery from the power saving mode. The infrared array sensor 100 converts the obtained temperature distribution information about the heat source (human body) into a digital signal and transmits the digital signal to the sensor unit CPU 101.

The sensor unit CPU 101 analyzes the temperature distribution information about the heat source (human body) received from the infrared array sensor 100 according to a program stored in the ROM 102. The RAM 103 is a working memory of the sensor unit CPU 101. If the sensor unit CPU 101 determines that the heat source (human body) approaches the image forming apparatus 1000, the sensor unit CPU 101 issues a normal operation power mode shift request (energization request signal) to the CPU 1040. Upon receiving the energization request signal, the CPU 1040 controls the power supply control unit 1120 to restore the power mode of the image forming apparatus 1000 to the normal operation power mode.

The sensor unit 1080 is powered by the power supply unit 1130 via the controller unit 1030 even in the power saving mode. While the infrared array sensor 100 is constantly supplied with power, the power supply to the sensor unit CPU 101, the RAM 103, and the ROM 102 may be stopped as appropriate. In such a case, the sensor unit CPU 101, the RAM 103, and the ROM 102 are immediately supplied with power if the infrared array sensor 100 shows a predetermined reaction.

In this example, the power supply unit 1130 is configured to supply power to the sensor unit 1080 via the controller unit 1030. However, depending on the configuration of the image forming apparatus 1000, the power supply unit 1130 may directly supply power to the sensor unit 1080. In addition, the power supply unit 1130 may be directly notified of the energization request signal output from the sensor unit CPU 101 and restore the power mode of the image forming apparatus 1000 to the normal operation power mode.

Figure 2:
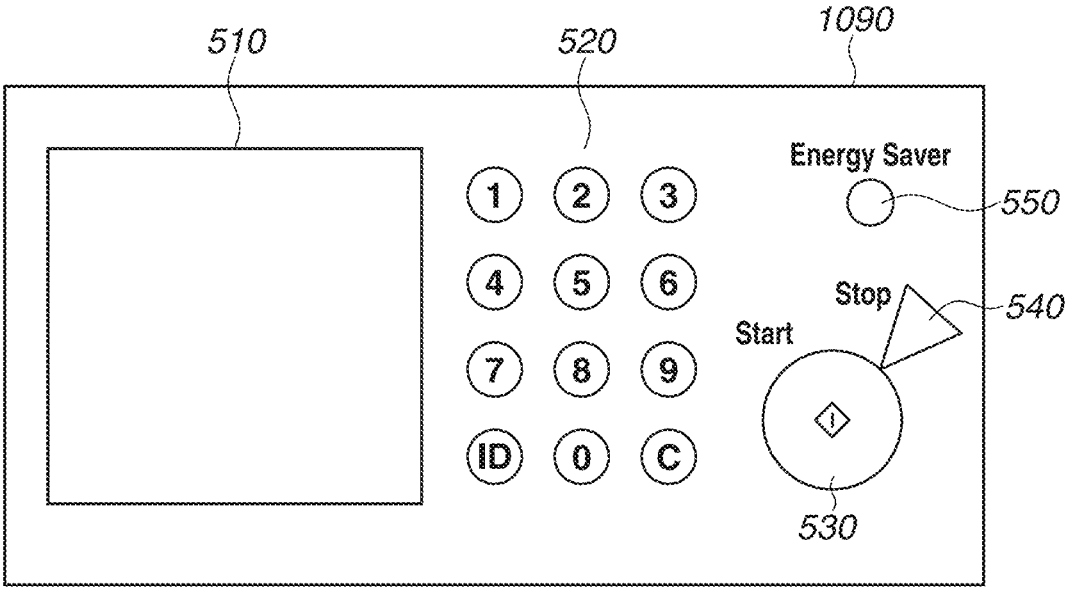
FIG. 2 is a diagram illustrating an example of an appearance of an operation unit.

FIG. 2 is a diagram illustrating an example of an appearance of the operation unit 1090.

The operation unit 1090 includes a display unit 510, a numerical keypad 520, a start key 530, a stop key 540, and a power saving key 550.

The display unit 510 displays a screen for operating the image forming apparatus 1000. For example, if a copy function of the image forming apparatus 1000 is selected, the image forming apparatus 1000 displays a screen specialized only in a copy operation on the display unit 510. Settings of the image forming apparatus 1000 are also made via the display unit 510.

The numerical keypad 520 is keys for inputting numerical values. The start key 503 is a key for making the image forming apparatus 1000 perform processing. For example, if the copy function of the image forming apparatus 1000 is selected and the start key 530 is pressed, the image forming apparatus 1000 performs a copy operation. The stop key 540 is a key for stopping processing of the image forming apparatus 1000. For example, if the stop key 540 is pressed while the image forming apparatus 1000 is performing a copy operation, the image forming apparatus 1000 aborts the copy operation.

The power saving key 550 is a key for shifting the image forming apparatus 1000 to the power saving mode. If the power saving key 550 is pressed, the image forming apparatus 1000 disconnects unnecessary power supply in the image forming apparatus 1000 and enters the power saving mode.

Figure 3A:
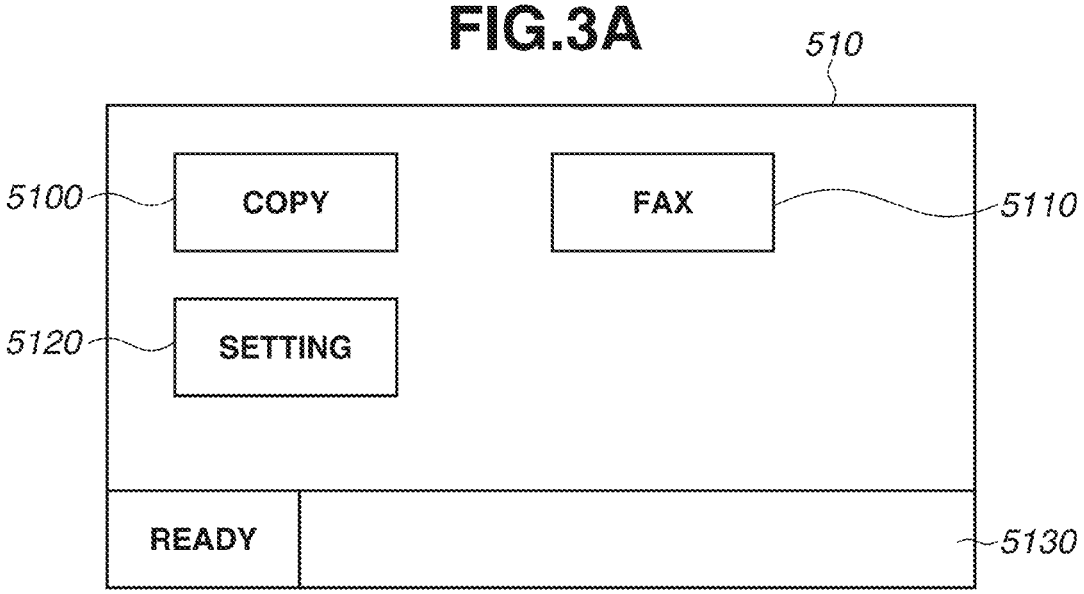
FIGS. 3A and 3B are diagrams illustrating examples of display information of a display unit.
Figure 3B:
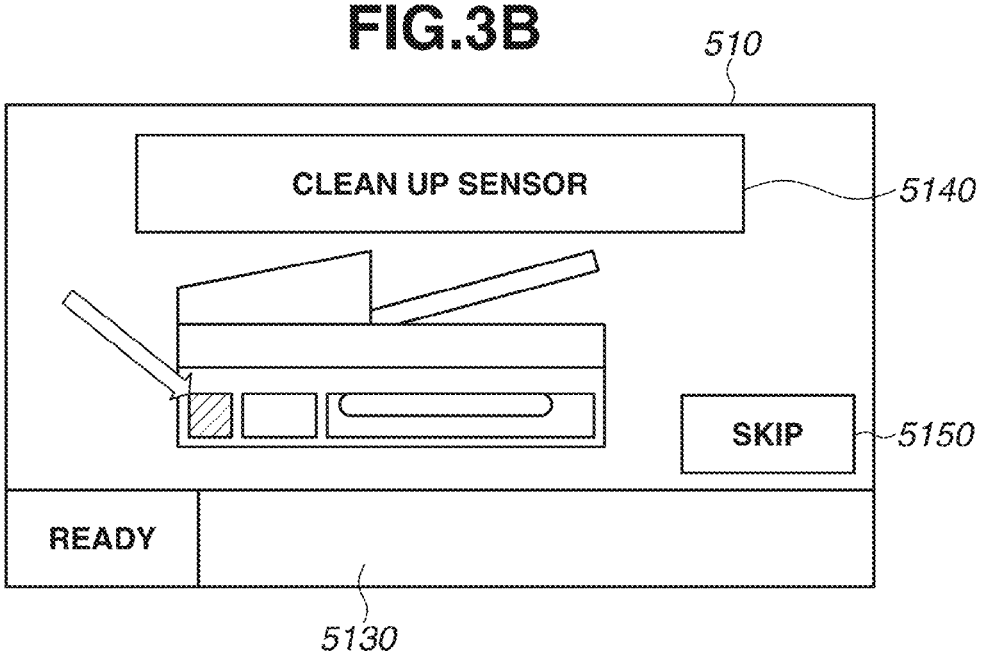

FIGS. 3A and 3B are diagrams illustrating examples of display information of the display unit 510.

FIG. 3A corresponds to an example of the display information when the image forming apparatus 1000 is in the normal operation power mode. If a copy 5100 button is pressed, the CPU 1040 switches the display information of the display unit 510 to a display specialized only in the copy function. Similarly, if a facsimile (FAX) 5110 button or a setting 5120 button is pressed, the CPU 1040 switches the display information of the display unit 510 to an appropriate one. FIG. 3B will be described below.

Figure 4A:
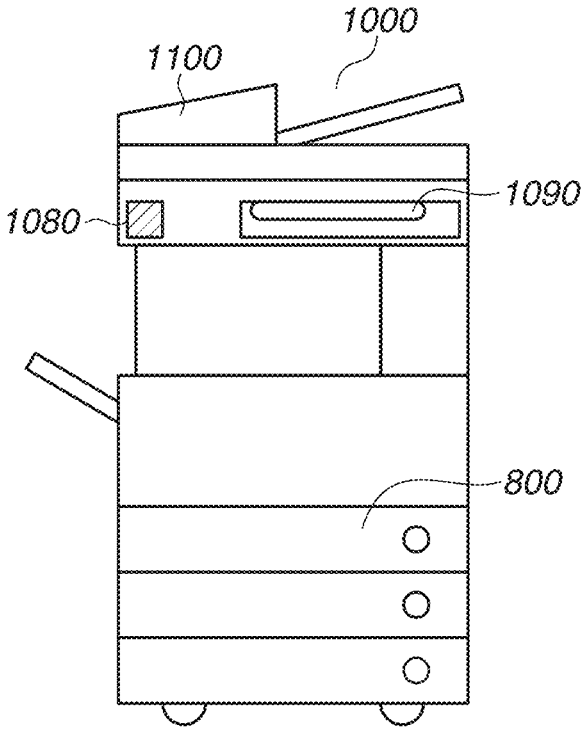
FIGS. 4A, 4B, and 4C are a diagram illustrating an appearance of the image forming apparatus and enlarged views of a sensor unit.
Figure 4B:
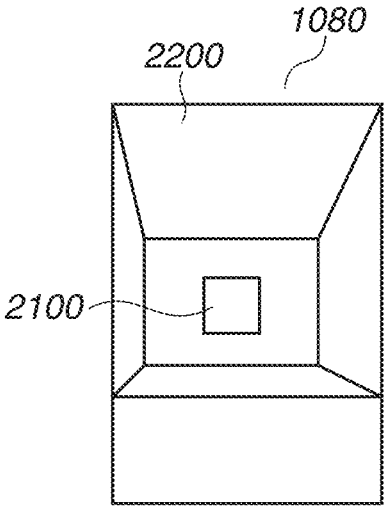
Figure 4C:
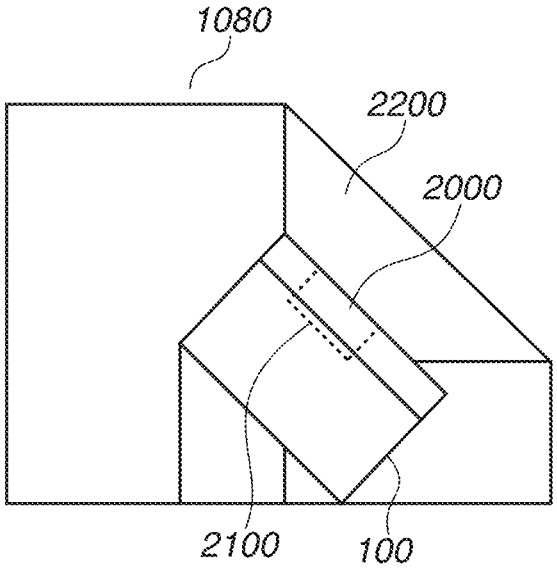

FIGS. 4A to 4C are a diagram illustrating an appearance of the image forming apparatus 1000 and enlarged views of the sensor unit 1080. FIG. 4A corresponds to an appearance diagram of the image forming apparatus 1000. FIG. 4B corresponds to an enlarged view of the sensor unit 1080. FIG. 4C corresponds to a side view of the sensor unit 1080.

As illustrated in FIG. 4A, the sensor unit 1080 is installed on the left of the operation unit 1090. In FIGS. 4B and 4C, an infrared light receiving unit 2100 (hereinafter, light receiving unit) is a part of the infrared array sensor 100 which receives infrared rays. The infrared light receiving elements of the infrared array sensor 100 are arranged in the light receiving unit 2100. A mold 2200 is a cover that covers the infrared array sensor 100 and a substrate on which the sensor unit CPU 101, the RAM 103, and the ROM 102 are mounted. The mold 2200 has an opening 2000 which is formed to expose the light receiving unit 2100 of the infrared array sensor 100 to the light.

Figure 5:
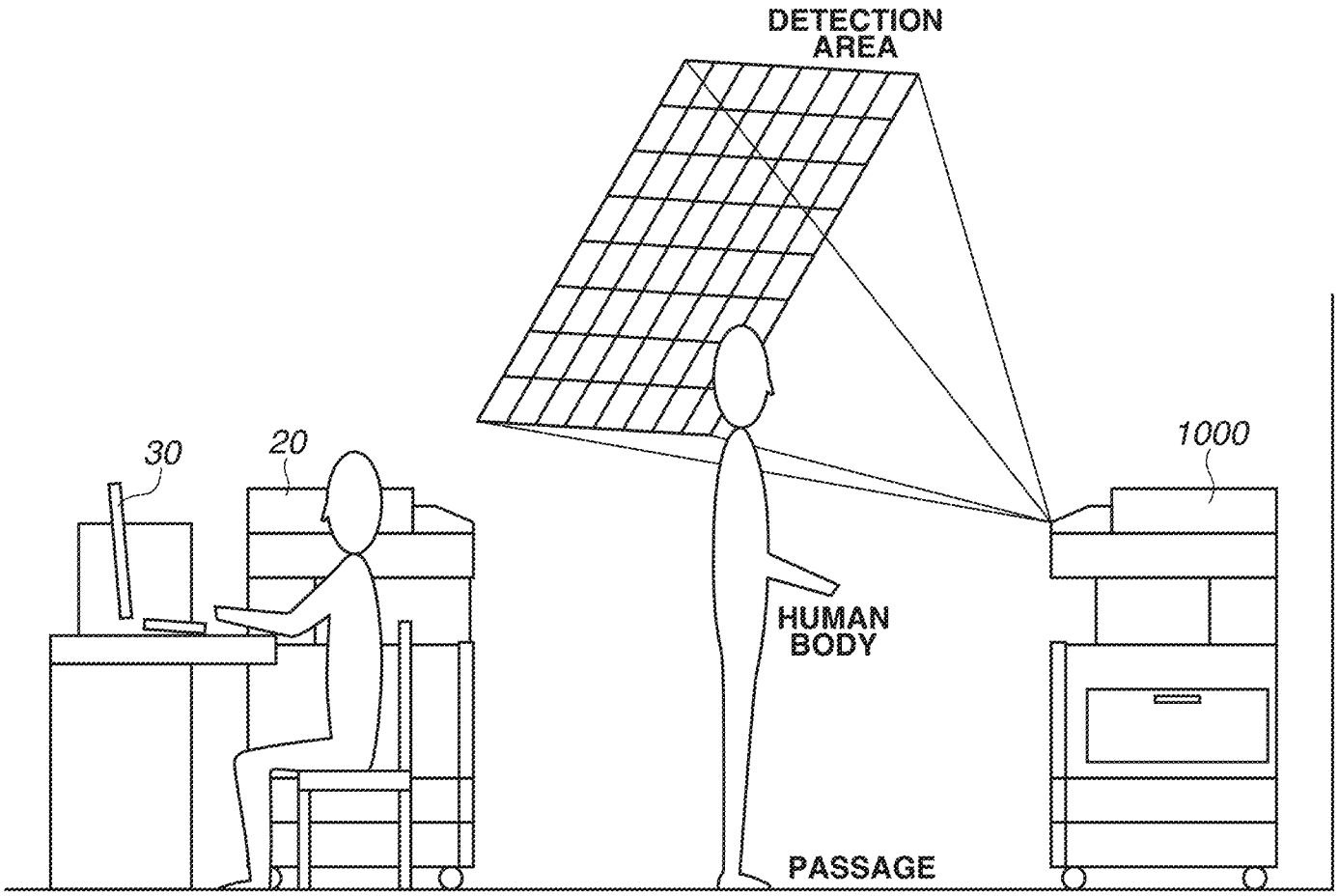
FIG. 5 is a diagram illustrating an example of a detection area of an infrared array sensor.

As illustrated in FIG. 4C, the infrared array sensor 100 is arranged in the mold 2200 with the light receiving unit 2100 obliquely upward. As illustrated in FIG. 5, such an arrangement improves the accuracy in detecting a human. With such an arrangement, however, dust accumulates in the opening 2000 or near the opening 2000. The light receiving unit 2100 (infrared array sensor 100) can be blocked by the dust, and the light receiving unit 2100 may fail to receive infrared rays.

FIG. 5 is a diagram illustrating an example of a detection area of the infrared array sensor 100.

When detecting the body temperature of a person, exposed skin portions can be detected to improve the detection accuracy. In the image forming apparatus 1000 according to the present exemplary embodiment, as illustrated in FIG. 5, the detection area of the infrared array sensor 100 is set forward and obliquely above the image forming apparatus 1000 so that the temperature of a human face can be detected. If the infrared array sensor 100 is directed forward and upward obliquely, heat from another apparatus 20 placed in the front, a personal computer (PC) or a monitor 30 on a desk, or a person sitting on a chair is not detected.

Figures 6A, 6B:
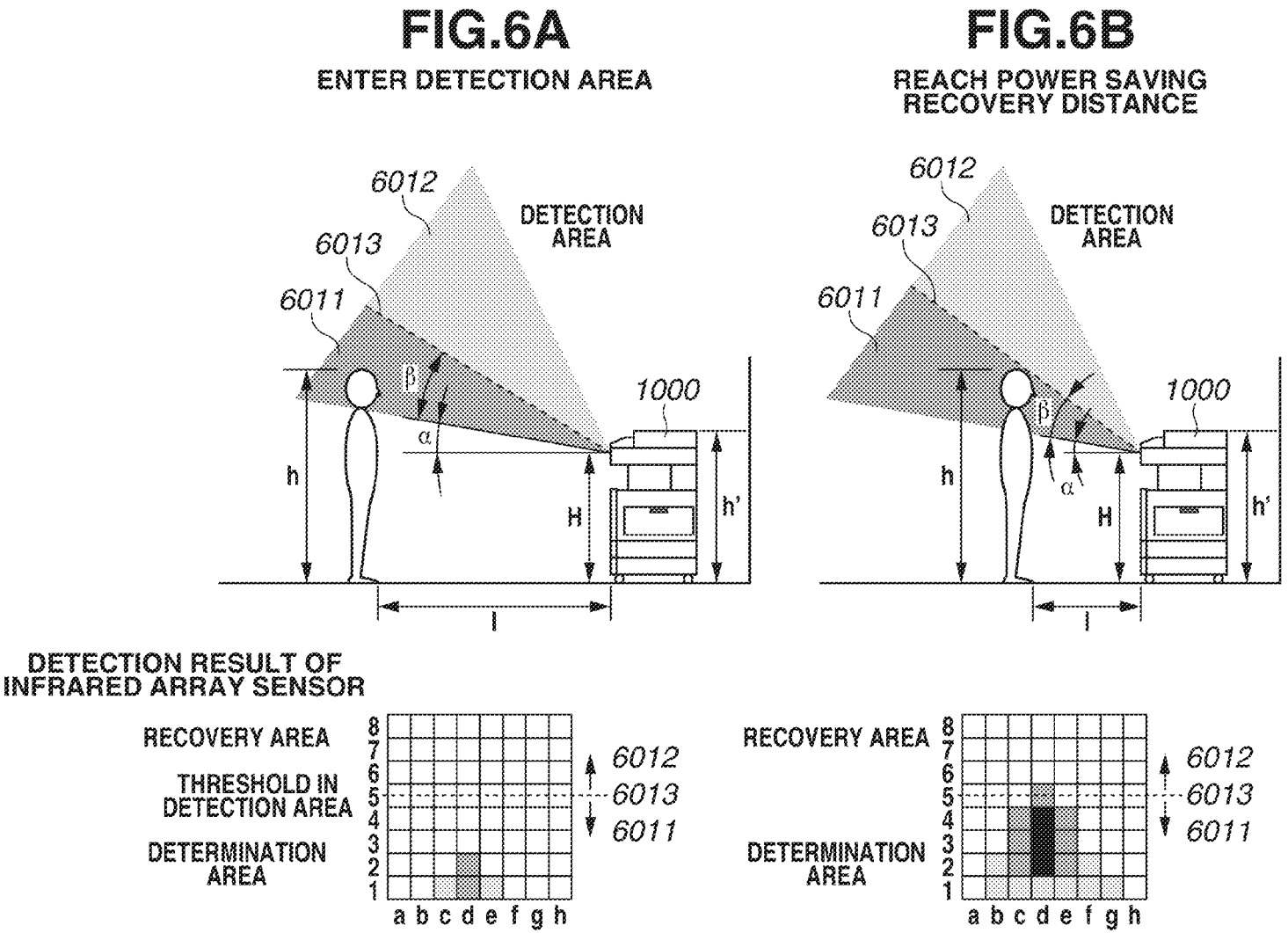
FIGS. 6A and 6B are diagrams illustrating examples of a detection result of the infrared array sensor according to a distance between the image forming apparatus and a human body.

FIGS. 6A and 6B are diagrams illustrating examples of a detection result of the infrared array sensor 100 according to a distance between the image forming apparatus 1000 and a human body.

The distance between the image forming apparatus 1000 and the human body is illustrated on the upper side. The detection result of the infrared array sensor 100 at that distance is illustrated on the lower side. The infrared array sensor 100 used in the present exemplary embodiment is a sensor including a total of 64 infrared light receiving elements arranged in eight rows 1 to 8 and eight columns a to h. However, this is not restrictive. Any infrared array sensor including a plurality of elements arranged on a line or in a grid-like configuration may be used. In the following description, to specify the positions of the infrared light receiving elements of the infrared array sensor 100, the infrared light receiving elements will be indicated as infrared light receiving elements 1*a* to 8*h*.

FIG. 6A illustrates a case where the heat source (human body) enters a detectable distance of the infrared array sensor 100. The detection result of the infrared array sensor 100 shows that the heat source is detected in several lower positions such as the infrared light receiving elements 1*c*, 1*d*, 1*e*, and 2*d*. In FIG. 6B, the heat source (human body) further approaches the image forming apparatus 1000. The detection result of the infrared array sensor 100 shows that the area of temperature detection expands upward from the first row to the second, third, fourth, and fifth rows above, and horizontally from row d to rows c and e to rows b and f.

While the person moves from the position of FIG. 6A to the position of FIG. 6B, the sensor unit CPU 101 determines whether the person is approaching the image forming apparatus 1000 based on the detection result in a determination area 6011. If the detection area of the heat source (human body) exceeds a predetermined threshold 6013 and enters a recovery area 6012, the sensor unit CPU 101 determines that the heat source (human body) has approached within a predetermined distance (power saving recovery distance) from the image forming apparatus 1000. If the image forming apparatus 1000 is in the power saving mode and the sensor unit CPU 101 determines that the heat source (human body) has approached within the predetermined distance (power saving recovery distance) from the image forming apparatus 1000, the sensor unit CPU 101 issues the normal operation power mode shift request to the CPU 1040. Upon receiving the normal operation power mode shift request, the CPU 1040 controls the power supply control unit 1120 to restore the image forming apparatus 1000 to the normal operation power mode.

Processing for detecting dust adhering to the infrared array sensor 100 will be described below with reference to FIG. 7.

Figure 7:
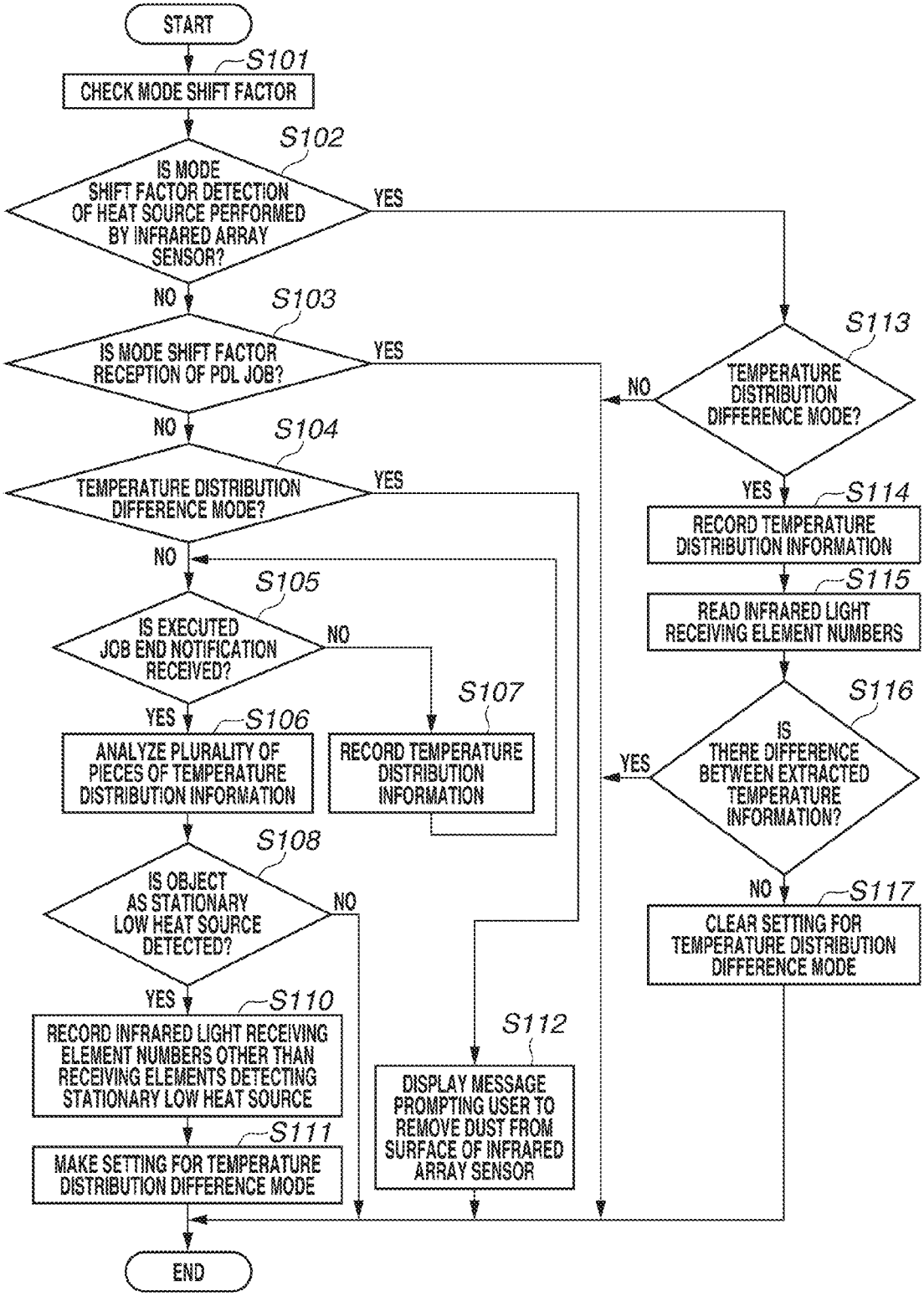
FIG. 7 is a flowchart illustrating an example of dust detection processing according to a first exemplary embodiment.

FIG. 7 is a flowchart illustrating an example of dust detection processing according to the first exemplary embodiment. The processing of this flowchart is implemented by the sensor unit CPU 101 reading and executing a program stored in the ROM 102.

If the sensor unit CPU 101 detects by a recovery signal output from the CPU 1040 that the power mode of the image forming apparatus 1000 shifts from the power saving mode to the normal operation power mode, the sensor unit CPU 101 starts the processing of this flowchart.

In step S101, the sensor unit CPU 101 performs processing for checking a mode shift factor when the image forming apparatus 1000 shifts from the power saving mode to the normal operation power mode. The sensor unit CPU 101 can check the mode shift factor by communicating with the CPU 1040 via a bus 1150.

In step S102, the sensor unit CPU 101 performs processing for determining whether the mode shift factor is detection of a heat source (human body) by the infrared array sensor 100. If it is determined that the mode shift factor is not the detection of a heat source (human body) by the infrared array sensor 100 (NO in step S102), the processing proceeds to step S103.

In step S103, the sensor unit CPU 101 performs processing for determining whether the mode shift factor is reception of a page description language (PDL) job. If it is determined that the mode shift factor is the reception of a PDL job (YES in step S103), the processing of the flowchart ends.

On the other hand, if it is determined that the mode shift factor is not the reception of a PDL job (NO in step S103), the processing proceeds to step S104. Mode shift factors here include, for example, the pressing of the power saving key 550, the setting of a document to a not-illustrated automatic document feeder (ADF) of the scanner unit 1100, the opening or closing of a not-illustrated pressing plate of the scanner unit 1100, and the setting of a sheet to a not-illustrated manual feed tray of the print unit 1110. In such cases, despite the presence of the user in the front of the image forming apparatus 1000, the image forming apparatus 1000 does not recover from the power saving mode to the normal operation power mode because of a determination based on the detection of a high heat source by the infrared array sensor 100. The image forming apparatus 1000 recovers owing to a factor other than the determination.

In step S104, the sensor unit CPU 101 performs processing for determining whether a mode of analyzing the temperature distribution information about the heat source (human body) received from the infrared array sensor 100 is set to a temperature distribution difference mode.

The temperature distribution difference mode will be described below.

The sensor unit CPU 101 usually obtains temperature information from the infrared light receiving elements constituting the infrared array sensor 100 (in the present exemplary embodiment, 8×8=64 infrared light receiving elements). The temperature distribution difference mode is a mode in which the sensor unit CPU 101 determines the approach of a heat source (human body) by using the temperature information about infrared light receiving elements that can detect a temperature change among the infrared light receiving elements constituting the infrared array sensor 100.

Figure 8A:
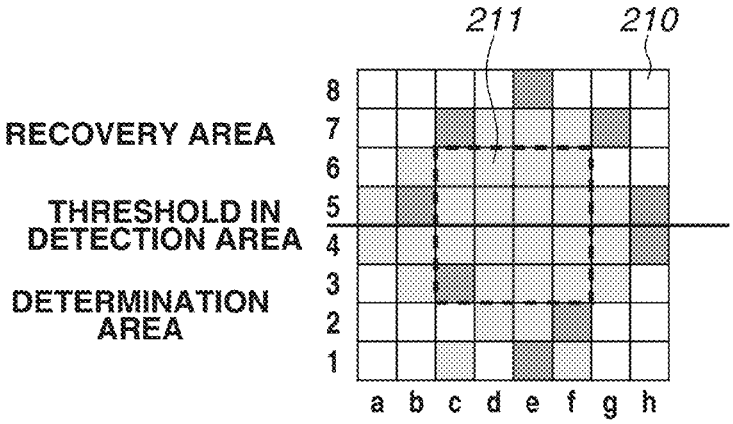
FIGS. 8A and 8B are conceptual diagrams illustrating examples of temperature distribution information of the infrared array sensor.
Figure 8B:
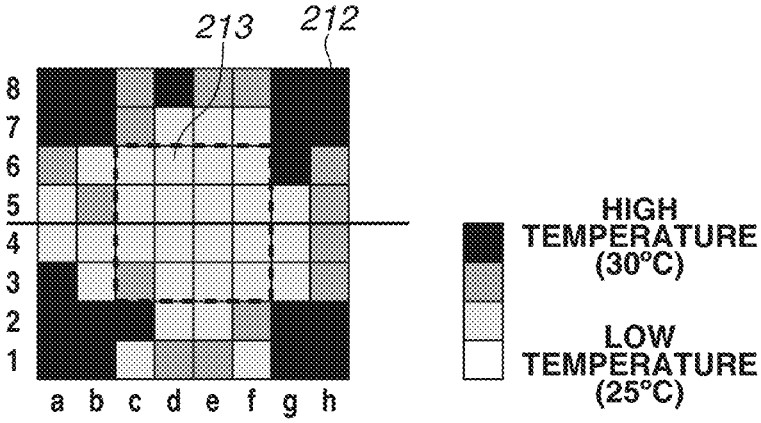

If the sensor unit CPU 101 detects a location where the temperature distribution information shows no temperature change (for example, a broken-lined area 211 in FIG. 8A and a broken-lined area 213 in FIG. 8B), the sensor unit CPU 101 extracts infrared light receiving elements which can detect a temperature change based on the temperature distribution information, and enters the temperature distribution difference mode. In the example of FIGS. 8A and 8B, the infrared light receiving elements 8*a*, 8*b*, 7*a*, and 7*b* are infrared light receiving elements which can detect a temperature change based on the temperature distribution information. For example, suppose that a heat source (human body) is detected by the infrared array sensor 100 (for example, high temperature is detected by the infrared light receiving element 8*a* of FIG. 8B). In such a case, if the sensor unit CPU 101 detects an object which is a stationary low heat source (described below) in the temperature distribution information, the sensor unit CPU 101 extracts infrared light receiving elements which can detect a temperature change according to the temperature distribution information, and enters the temperature distribution difference mode. In the temperature distribution difference mode, the sensor unit CPU 101 detects the approach of the heat source (human body) based on the temperature information detected by the infrared light receiving elements extracted as described above (for example, the infrared light receiving elements 8*a*, 8*b*, 7*a*, and 7*b* of FIGS. 8A and 8B).

FIGS. 8A and 8B are conceptual diagrams illustrating examples of the temperature distribution information of the infrared array sensor 100. For example, in FIGS. 8A and 8B, the infrared light receiving elements 8*a*, 8*b*, 7*a*, and 7*b* are extracted as infrared light receiving elements which can detect a temperature change based on the temperature distribution information. In the temperature distribution difference mode, the sensor unit CPU 101 detects the approach of the heat source (human body) based on the temperature information output from the extracted infrared light receiving elements (in FIGS. 8A and 8B, the infrared light receiving elements 8*a*, 8*b*, 7*a*, and 7*b*).

Returning to the description of the flowchart, in step S104, if the mode of analyzing the temperature distribution information about the heat source (human body) received from the infrared array sensor 100 is determined to be the temperature distribution difference mode (YES in step S104), the processing proceeds to step S112.

In step S112, the sensor unit CPU 101 performs processing for instructing the display unit 510 of the operation unit 1090 to display a message prompting the user to remove dust from the surface of the infrared array sensor 100 as illustrated in FIG. 3B. The processing of the flowchart ends.

FIG. 3B is a diagram illustrating an example of the display information when the sensor unit CPU 101 determines that the infrared array sensor 100 is covered with dust. If the sensor unit CPU 101 gives a display instruction to the CPU 1040 in the processing of step S112 in FIG. 7, the CPU 1040 switches the display information of the display unit 510 to that prompting the removal of dust. When the CPU 1040 switches the display information of the display unit 510 to that prompting the removal of dust, the CPU 1040 may simultaneously issue an alarm and/or output a message 5140 or the like by using a not-illustrated speaker. If a skip 5150 button of FIG. 3B is pressed, the CPU 1040 switches the display information of the display unit 510 to that of FIG. 3A, and notifies the sensor unit CPU 101 thereof. The CPU 1040 displays an apparatus state of the image forming apparatus 1000 in a status 5130. The CPU 1040 may display in the status 5130 that the temperature distribution difference mode is set.

In the foregoing step S104, if the mode of analyzing the temperature distribution information about the heat source (human body) received from the infrared array sensor 100 is determined to not be the temperature distribution difference mode (NO in step S104), the processing proceeds to step S105.

In step S105, the sensor unit CPU 101 performs processing for determining whether an executed job end notification about the image forming apparatus 1000 is received from the CPU 1040. If the executed job end notification of the image forming apparatus 1000 is determined to not be received from the CPU 1040 (NO in step S105), the processing proceeds to step S107.

In step S107, the sensor unit CPU 101 records the temperature distribution information received from the infrared array sensor 100 into the RAM 103. The number of pieces of temperature distribution information to be recorded in the RAM 103 is determined in advance. The sensor unit CPU 101 records the predetermined number of pieces of temperature distribution information into the RAM 103. Alternatively, the sensor unit CPU 101 may record the temperature distribution information into the RAM 103 at a predetermined cycle. After the end of the recording of the temperature distribution information, the processing returns to step S105. In such a manner, the temperature distribution information at different times during execution of a job can be obtained.

In the foregoing step S105, if it is determined that the executed job end notification about the image forming apparatus 1000 has been received from the CPU 1040 (YES in step S105), the processing proceeds to step S106.

In step S106, the sensor unit CPU 101 performs processing for reading and analyzing the plurality of pieces of temperature distribution information recorded in the RAM 103 in the foregoing step S107. In step S108, the sensor unit CPU 101 performs processing for determining whether an object which is a stationary low heat source is detected from the plurality of pieces of temperature distribution information analyzed in the foregoing step S106.

An object which is a stationary low heat source will be described.

An object which is a stationary low heat source refers to dust blocking the light receiving unit 2100. The infrared array sensor 100 detects an object (heat source) closest to the light receiving unit 2100. If the light receiving unit 2100 is blocked by dust, even though a heat source (human body) which is a heat source at a higher temperature than the dust approaches the infrared array sensor 100, the dust-covered portion is not able to detect the high heat source.

Figure 9A:
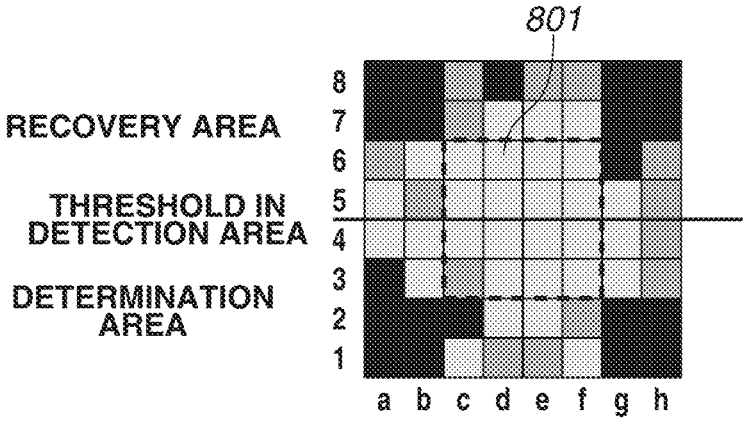
FIGS. 9A, 9B, and 9C are diagrams illustrating examples of temperature distribution information obtained by a sensor unit central processing unit (CPU).
Figure 9B:
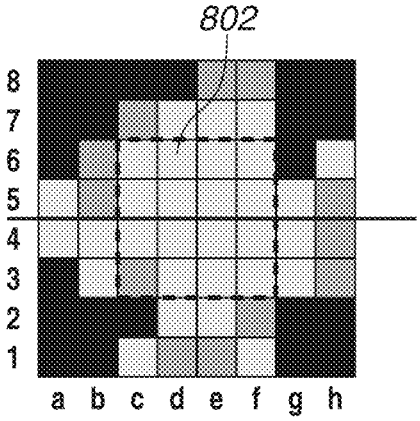
Figure 9C:
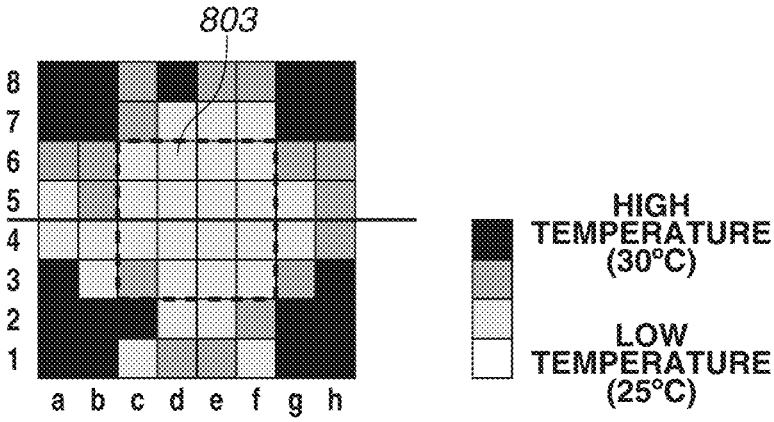

FIGS. 9A to 9C are diagrams illustrating examples of the temperature distribution information obtained by the sensor unit CPU 101 in step S107 of FIG. 7.

FIGS. 9A, 9B, and 9C illustrate temperature distribution information at different times. When FIGS. 9A, 9B, and 9C are compared, for example, a broken-lined area 801, a broken-lined area 802, and a broken-lined area 803 show no temperature variation and detect temperatures lower than a high-temperature heat source (for example, 30° C.) which the infrared light receiving elements 8*a* and 7*b* detect. More specifically, despite the presence of the high-temperature heat source (human body) near the image forming apparatus 1000, the infrared light receiving elements 5*c*, 5*d*, and 3*f* remain unchanged at different times and are outputting information about a temperature lower than a predetermined temperature (for example, 30° C.) Consequently, it is determined that an object which is a stationary low heat source (dust) is present on (adhering to) the surface of the infrared array sensor 100. Besides, it is also determined that an object which is a stationary low heat source is present in the broken-lined areas 211 and 213 in FIGS. 8A and 8B.

Return to the description of the flowchart.

In the foregoing step S108, if the sensor unit CPU 101 determines that no object which is a stationary low heat source is detected by the light receiving unit 2100 of the infrared array sensor 100 (NO in step S108), the processing of the flowchart ends.

On the other hand, for example, as illustrated in FIGS. 9A to 9C, if it is determined that an object which is a stationary low heat source is detected by the light receiving unit 2100 of the infrared array sensor 100 (YES in step S108), the processing proceeds to step S110.

In step S110, the sensor unit CPU 101 extracts infrared light receiving element numbers other than those detecting the stationary low heat source in the foregoing step S108, and records the infrared light receiving element numbers into the RAM 103.

A description will be given with reference to FIGS. 9A to 9C. The infrared light receiving element 8*a* detects a temperature (in the present exemplary embodiment, 30° C.) higher than the infrared light receiving elements arranged in the broken-lined area 801. The sensor unit CPU 101 then extracts the infrared light receiving element number corresponding to the infrared light receiving element 8*a* (in the present exemplary embodiment, "8*a*") as one of an infrared light receiving elements for checking a heat source (human body) in the temperature distribution information, and records the infrared light receiving element number into the RAM 103. In a similar manner, the sensor unit CPU 101 extracts the infrared receiving element numbers corresponding to other infrared light receiving elements detecting a temperature higher than the infrared light receiving elements arranged in the broken-lined area 801, and records the infrared receiving element numbers into the RAM 103.

In step S111, the sensor unit CPU 101 makes a setting for performing an analysis of the temperature distribution information about the heat source (human body) received from the infrared array sensor 100 in the temperature distribution difference mode. Specifically, the sensor unit CPU 101 records a setting flag for performing the analysis of the temperature distribution information in the temperature distribution difference mode into the RAM 103 (for example, sets a setting flag of "1"). When the setting of the temperature distribution difference mode ends, the sensor unit CPU 101 ends the processing of the flowchart. Even if yes in the foregoing step S108, the sensor unit CPU 101 may provide a display (notification to a user) like the one in the foregoing step S112.

If the image forming apparatus 1000 enters the power saving mode, the sensor unit CPU 101 performs processing for reading the setting flag for performing the analysis in the temperature distribution difference mode, recorded in the RAM 103 in the foregoing step S111. If the setting flag is recorded, the sensor unit CPU 101 performs processing for determining whether there is a heat source (human body) by using the temperature distribution information of the area data portion (infrared light receiving element numbers) stored in the foregoing step S110.

If the number of infrared light receiving elements other than those detecting a stationary low heat source extracted in the foregoing step S110, is less than or equal to a predetermined number (for example, zero), or if there is no such extracted infrared light receiving element in the recovery area 6012 (FIG. 6A), the sensor unit CPU 101 may perform processing for instructing the display unit 510 of the operation unit 1090 to display a message prompting the user to remove dust from the surface of the infrared array sensor 100 like FIG. 3B. In such a case, the sensor unit CPU 101 may leave the temperature distribution difference mode unset.

In the foregoing step S102, if the mode shift factor is determined to be the detection of a heat source (human body) by the infrared array sensor 100 (YES in step S102), the processing proceeds to step S113. In step S113, the sensor unit CPU 101 performs processing for determining whether the mode of analyzing the approach of the heat source (human body) based on the temperature distribution information obtained from the infrared array sensor 100 is the temperature distribution difference mode.

If the mode of analyzing the approach of the heat source (human body) is determined to not be the temperature distribution difference mode (NO in step S113), the processing of the flowchart ends.

On the other hand, if the mode of analyzing the approach of the heat source (human body) is determined to be the temperature distribution difference mode (YES in step S113), the processing proceeds to step S114.

In step S114, the sensor unit CPU 101 records the temperature distribution information received from the infrared array sensor 100 into the RAM 103. In step S115, the sensor unit CPU 101 performs processing for reading the infrared light receiving element numbers stored in the RAM 103 in the foregoing step S110 from the RAM 103.

In step S116, the sensor unit CPU 101 reads the temperature distribution information recorded in the foregoing 5114 from the RAM 103, and extracts the temperature information (temperature information 1) output from the infrared light receiving elements corresponding to the infrared light receiving element numbers read from the RAM 103 in the foregoing step S115. The sensor unit CPU 101 further extracts the temperature information (temperature information 2) output from the infrared light receiving elements having infrared light receiving element numbers not corresponding to those read from the RAM 103 in the foregoing step S115. The sensor unit CPU 101 then performs processing for comparing the extracted pieces of temperature information (comparing the temperature information 1 with the temperature information 2) and determining whether there is a difference between the pieces of temperature information.

If it is determined that there is a difference between temperature information (YES in step S116), the processing of the flowchart ends. In such a case (where there is a difference between the temperature information 1 and the temperature information 2), the sensor unit CPU 101 may perform processing for instructing the display unit 510 of the operation unit 1090 to display a message prompting the user to remove dust from the surface of the infrared array sensor 100 like FIG. 3B.

On the other hand, if it is determined that there is no difference between temperature information (NO in step S116), the processing proceeds to step S117. In such a case, the infrared light receiving elements corresponding to the infrared light receiving element numbers read from the RAM 103 in the foregoing step S115 and those not corresponding to the infrared light receiving element numbers both detect a high temperature (for example, 30° C.) The object which is a stationary low heat source such as dust, can therefore be considered to have disappeared.

In step S117, the sensor unit CPU 101 performs processing for clearing the setting of the temperature distribution difference mode. The sensor unit CPU 101 deletes the setting flag for performing in the temperature distribution difference mode the analysis of the temperature distribution information recorded in the RAM 103 in the foregoing step S111. The processing of the flowchart ends.

Figure 10:
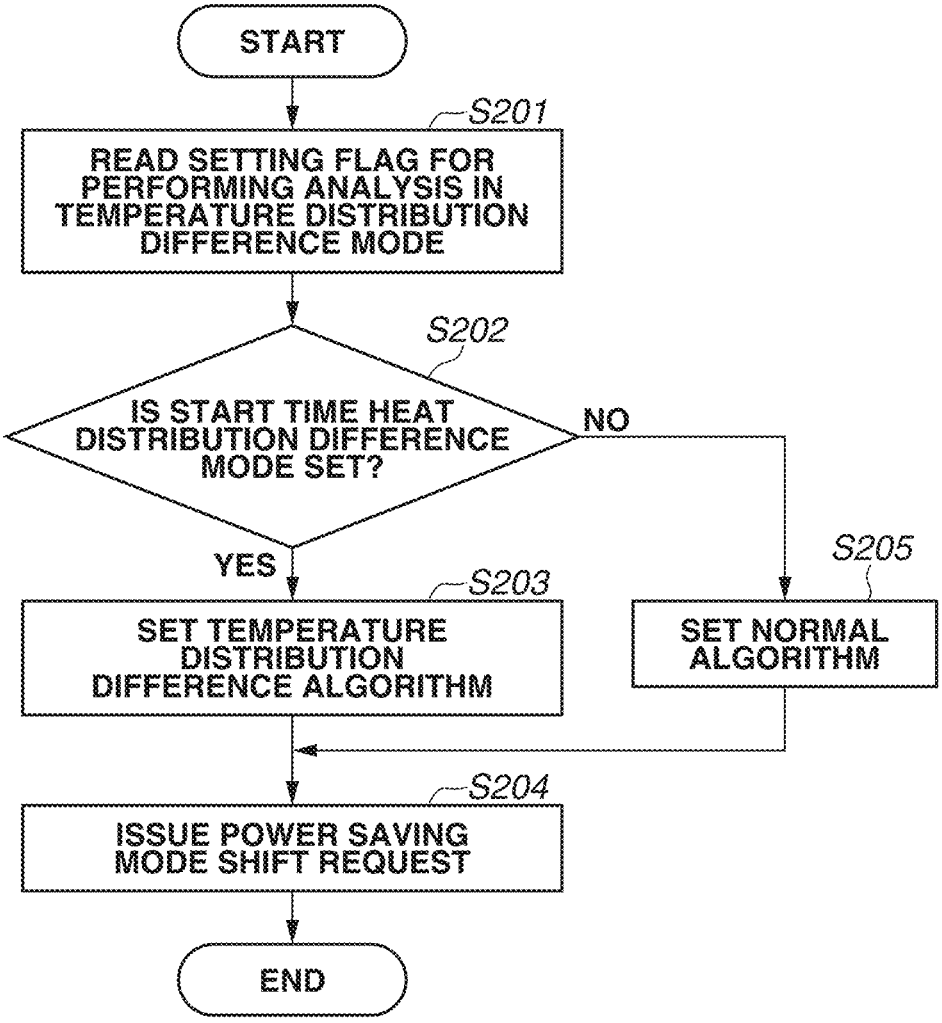
FIG. 10 is a flowchart illustrating an example of processing for setting a recovery condition by the infrared array sensor when entering a power saving mode.

FIG. 10 is a flowchart illustrating an example of processing for setting a recovery condition of the infrared array sensor 100 when the image forming apparatus 1000 enters the power saving mode. The processing of this flowchart is implemented by the sensor unit CPU 101 reading and executing a program stored in the ROM 102.

When the image forming apparatus 1000 enters the power saving mode, the sensor unit CPU 101 starts the processing of this flowchart.

In step S201, the sensor unit CPU 101 performs processing for reading from the RAM 103 the setting flag for performing an analysis of temperature distribution information in the temperature distribution difference mode.

In step S202, the sensor unit CPU 101 performs processing for determining whether a start time heat distribution difference mode is set, depending on whether is recorded as the setting flag for performing an analysis of temperature distribution information in the temperature distribution difference mode. "1" is read from the RAM 103 in the foregoing step S201.

If "1" is recorded as the setting flag, the sensor unit CPU 101 determines that the start time heat distribution difference mode is set (YES in step S202), and the processing proceeds to step S203.

In step S203, the sensor unit CPU 101 performs processing for setting a temperature distribution difference algorithm to the detection of a heat source (human body) by the infrared array sensor 100. The processing proceeds to step S204.

In the foregoing step S202, if "1" is determined to not be recorded as the setting flag, the sensor unit CPU 101 determines that the start time heat distribution difference mode is not set (NO in step S202), and the processing proceeds to step S205.

In step S205, the sensor unit CPU 101 performs processing for setting a normal algorithm to the detection of a heat source (human body) by the infrared array sensor 100. The processing proceeds to step S204.

In step S204, the sensor unit CPU 101 performs processing for issuing a power saving mode shift request to the CPU 1040. Upon receiving the power saving mode shift request, the CPU 1040 controls the power supply control unit 1120 to shift the image forming apparatus 1000 to the power saving mode.

Figure 11:
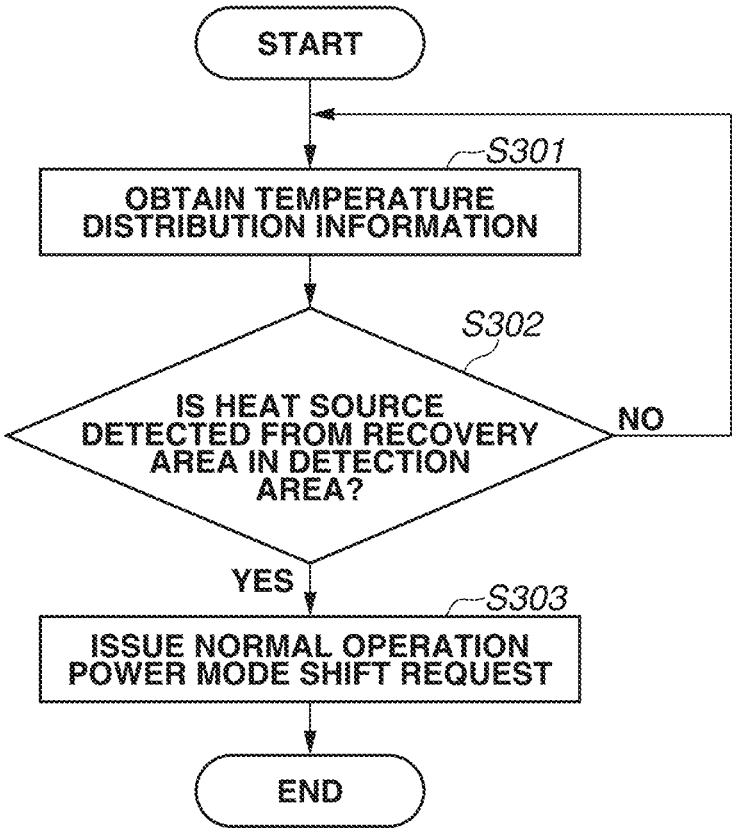
FIG. 11 is a flowchart illustrating an example of normal algorithm processing.

FIG. 11 is a flowchart illustrating an example of normal algorithm processing. The processing of this flowchart is implemented by the sensor unit CPU 101 reading and executing a program stored in the ROM 102.

In step S301, the sensor unit CPU 101 performs processing for obtaining the temperature distribution information from the infrared array sensor 100.

In step S302, the sensor unit CPU 101 determines whether a heat source (human body) is detected in the recovery area 6012 (FIGS. 6A and 6B) in the detection area. If the sensor unit CPU 101 determines that no heat source (human body) is detected in the recovery area 6012 in the detection area (NO in step S302), the processing proceeds to step S301.

In the foregoing step S302, if it is determined that a heat source (human body) is detected in the recovery area 6012 in the detection area (YES in step S302), the processing proceeds to step S303.

In step S303, the sensor unit CPU 101 performs processing for issuing the normal operation power mode shift request to the CPU 1040. Upon receiving the normal operation power mode shift request, the CPU 1040 controls the power supply control unit 1120 to shift the image forming apparatus 1000 to the normal operation power mode.

Figure 12:
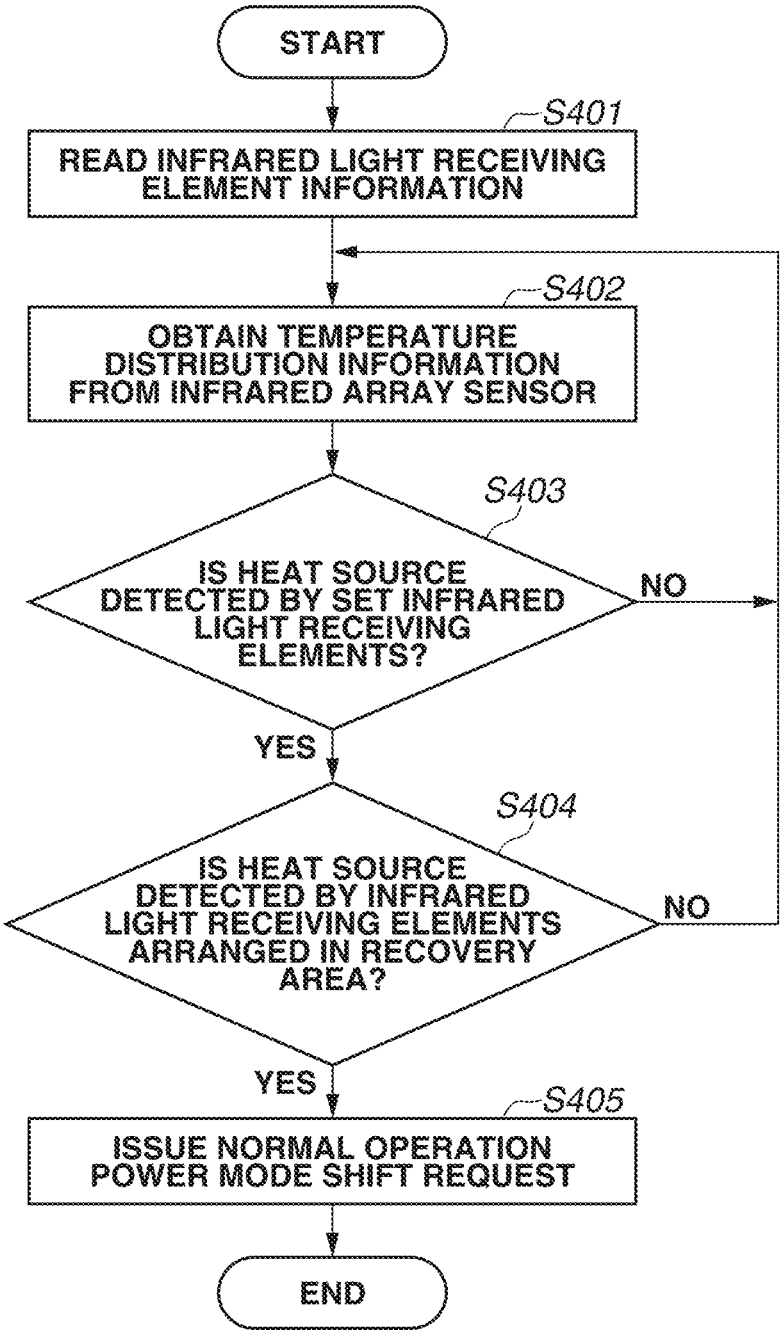
FIG. 12 is a flowchart illustrating an example of temperature distribution difference algorithm processing.

FIG. 12 is a flowchart illustrating an example of temperature distribution difference algorithm processing. The processing of this flowchart is implemented by the sensor unit CPU 101 reading and executing a program stored in the ROM 102.

In step S401, the sensor unit CPU 101 performs processing for reading from the RAM 103 infrared light receiving element information (infrared light receiving element numbers) for checking a heat source (human body) with the temperature distribution formation obtained from the infrared array sensor 100. The sensor unit CPU 101 hereinafter uses the temperature information output from the infrared light receiving elements corresponding to the infrared light receiving element numbers read here to determine whether the head source (human body) approaches the image forming apparatus 1000.

In step S402, the sensor unit CPU 101 performs processing for obtaining the temperature distribution information from the infrared array sensor 100.

In step S403, the sensor unit CPU 101 performs processing for determining whether the infrared light receiving elements corresponding to the infrared light receiving element numbers for checking for a heat source (human body) read in the foregoing step S401, detect a heat source (human body) in the temperature distribution information obtained in the foregoing step S402. If it is determined that no heat source is detected by the infrared light receiving elements set in the foregoing step S401 to check for a heat source (human body) (NO in step S403), the processing proceeds to the foregoing step S402.

In the foregoing step S403, if it is determined that a heat source is detected by the infrared light receiving elements set to check for a heat source (human body) in the foregoing step S401 (YES in step S403), the processing proceeds to step S404.

In step S404, the sensor unit CPU 101 performs processing for determining whether the heat source (temperature) detected in the foregoing step S403 is detected by an infrared light receiving element for checking a heat source and arranged in the recovery area 6012. If it is detected that the heat source is not detected by an infrared light source element for checking a heat source (human body) in the foregoing step S401 and arranged in the recovery area 6012 (NO in step S404), the processing returns to the foregoing step S402.

In the foregoing step S404, if it is detected that the heat source is detected by an infrared light receiving element for checking a heat source (human body) in the foregoing step S401 and arranged in the recovery area 6012 (YES in step S404), the processing proceeds to step S405. In step S405, the sensor unit CPU 101 performs processing for issuing the normal operation power mode shift request to the CPU 1040. Upon receiving the normal operation power mode shift request, the CPU 1040 controls the power supply control unit 1120 to shift the image forming apparatus 1000 to the normal operation power mode.

As has been described above, the first exemplary embodiment deals in the configuration for recording the temperature distribution information at predetermined cycles until the end of an executed job (i.e., while the user is near the image forming apparatus 1000), and analyzing the plurality of pieces of temperature distribution information recorded to detect an object which is a stationary low heat source. However, an exemplary embodiment of the present invention may be configured to detect an object which is a stationary low heat source by using temperature distribution information that is obtained a plurality of times at timings when a user operation is detected (i.e., at timings when the user is near the image forming apparatus 1000). For example, at timings when the power saving button 500 is pressed, when the pressing plate of the scanner unit 1100 is opened, when a document is set on the ADF of the scanner unit 1100, and when a sheet is set on the manual feed tray of the print unit 1110.

As described above, according to the first exemplary embodiment, it can be determined that the infrared array sensor 100 of non-light emission type is blocked by dust (dust can be detected), by detecting a state showing no temperature change (an object which is a stationary low heat source) from the temperature distribution information obtained from the infrared array sensor 100. In such a case, the analysis of the temperature distribution information about a heat source (human body) is performed based on infrared light receiving elements not detecting the object which is a stationary low heat source (the temperature distribution difference mode). As a result, even if there is dust adhering to the infrared array sensor 100, the heat source (human body) can be accurately detected for the image forming apparatus 1000 to recover. The image forming apparatus 1000 can also notify the user that the infrared array sensor 100 is blocked by dust, and prompt the user to remove the dust.

The foregoing first exemplary embodiment deals with the configuration in which the image forming apparatus 1000 obtains the temperature distribution information during execution of a job such copying, and detects that the light receiving unit 2100 of the infrared array sensor 100 is blocked by dust. In processing according to a second exemplary embodiment, the temperature distribution information when the power saving mode shifts to the normal operation power mode, is compared with the temperature distribution information when job processing of the image forming apparatus 1000 ends, to detect that the infrared array sensor 100 is blocked by dust. The processing will be described with reference to FIG. 13.

Figure 13:
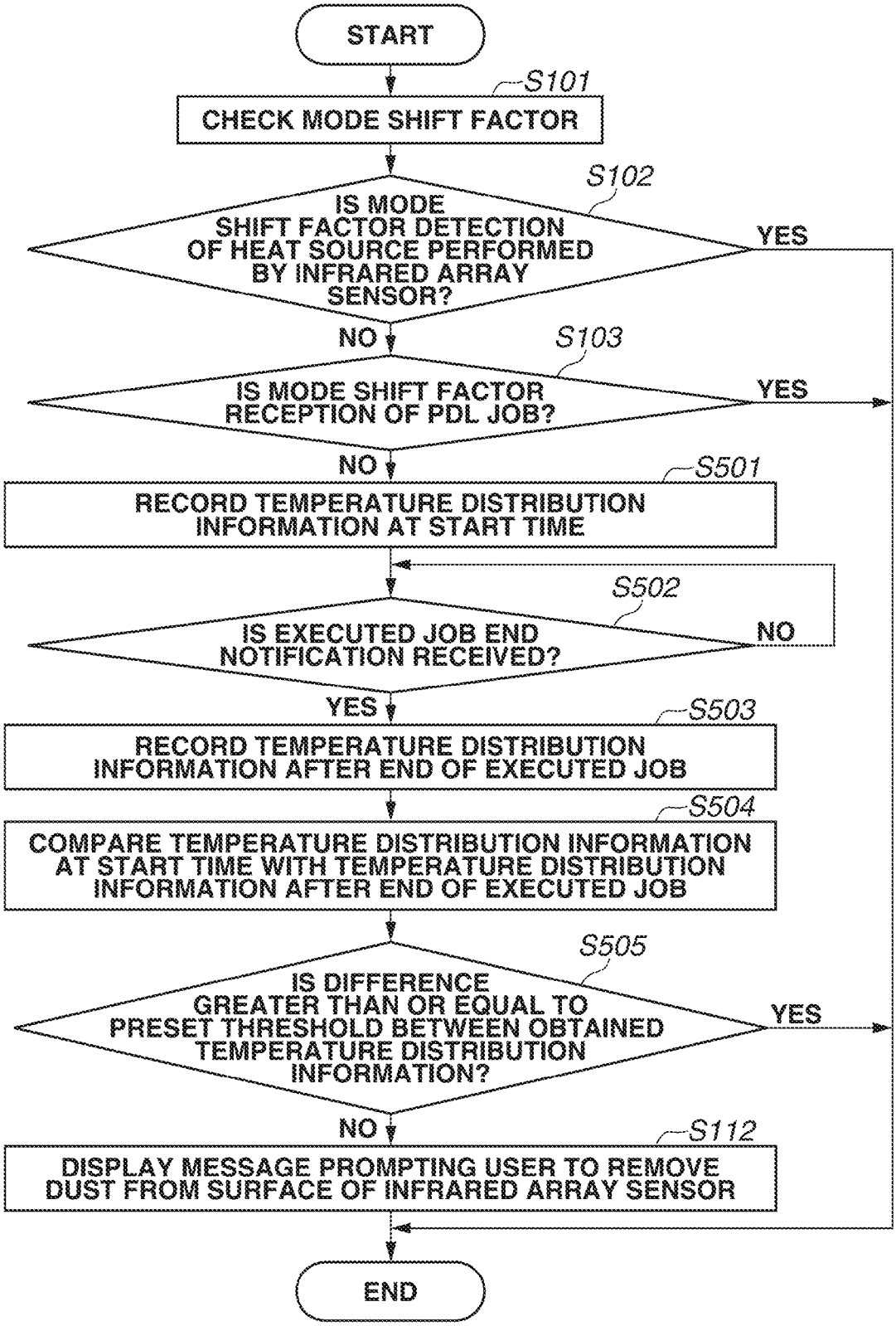
FIG. 13 is a flowchart illustrating an example of dust detection processing according to a second exemplary embodiment.

FIG. 13 is a flowchart illustrating an example of dust detection processing according to the second exemplary embodiment. The processing of this flowchart is implemented by the sensor unit CPU 101 reading and executing a program stored in the ROM 102. Steps similar to those of FIG. 7 are denoted by the same step numbers.

In step S501, the sensor unit CPU 101 records in the RAM 103 the temperature distribution information when the image forming apparatus 1000 starts up (i.e., immediately after the power saving mode is switched to the normal operation power mode), which is received from the infrared array sensor 100. In other words, the sensor unit CPU 101 records the temperature distribution information in a state where the user is in the front of the image forming apparatus 1000.

In step S502, the sensor unit CPU 101 performs processing for determining whether an executed job end notification about the image forming apparatus 1000 is received from the CPU 1040. If it is determined that an executed job end notification about the image forming apparatus 1000 is not received from the CPU 1040 (NO in step S502), the sensor unit CPU 101 repeats the determination processing of step S502.

In the foregoing step S502, if it is determined that an executed job end notification about the image forming apparatus 1000 is received from the CPU 1040 (YES in step S502), the processing proceeds to step S503.

In step S503, the sensor unit CPU 101 records in the RAM 103 the temperature distribution information after the end of the job executed by the image forming apparatus 1000, which is received from the infrared array sensor 100. Such processing is performed to record the temperature distribution information in a state where the user has disappeared from in the front of the image forming apparatus 1000 after the end of the job. The temperature distribution information may therefore be received from the infrared array sensor 100 when a predetermined time (which can be set, for example, by an administrator) has lapsed after the end of the executed job.

In step S504, the sensor unit CPU 101 performs processing for comparing the temperature distribution information recorded in the foregoing step S501 with the temperature distribution information recorded in the foregoing step S503. In step S505, the sensor unit CPU 101 performs processing for determining whether a difference is greater than or equal to a threshold between the temperature distribution information recorded in the foregoing step S501 and the temperature distribution information recorded in the foregoing step S503. For example, the threshold is set to, though not limited to, "5° C."

In the foregoing step S505, if it is determined that a difference is greater than or equal to the preset threshold between temperature distribution information (YES in step S505), the processing of the flowchart ends.

In the foregoing step S505, if it is determined that a difference is not greater than or equal to the preset threshold between the obtained temperature distribution information (NO in step S505), the processing proceeds to step S112. In step S112, the sensor unit CPU 101 determines that there is an object which is a stationary low heat source on (adhering to) the surface of the infrared array sensor 100, and notifies the user of a message prompting to remove the dust from the surface of the infrared array sensor 100. Details will be omitted. A description of the rest of the processing will also be omitted.

The second exemplary embodiment deals with the configuration in which the sensor unit CPU 101 detects dust by obtaining the temperature distribution information when the power mode of the image forming apparatus 1000 shifts from the power saving mode to the normal operation power mode and after a job ends. However, the following configuration may also be employed. For example, the sensor unit CPU 101 may be configured to store the temperature distribution information when the power mode of the image forming apparatus 1000 is the normal operation power mode, and further store the temperature distribution information after the image forming apparatus 1000 enters the power saving mode. Then, if the power mode of the image forming apparatus 1000 shifts from the power saving mode to the normal operation power saving mode, the sensor unit CPU 101 compares the temperature distribution information stored in advance (like steps S504 and S505) for dust detection. Like the first exemplary embodiment, a step of shifting to the temperature distribution difference mode may be added to the second exemplary embodiment.

As described above, according to the second exemplary embodiment, it can be determined that the infrared array sensor 100 of non-light emission type is blocked by dust (dust can be detected), and the user can be notified thereof and prompted to remove the dust.

A third exemplary embodiment deals with a configuration for obtaining temperature distribution information when a heat source (human body) is not near the image forming apparatus 1000, and detecting that the light receiving unit 2100 of the infrared array sensor 100 is blocked by dust. Details will be described below with reference to FIG. 14.

Figure 14:
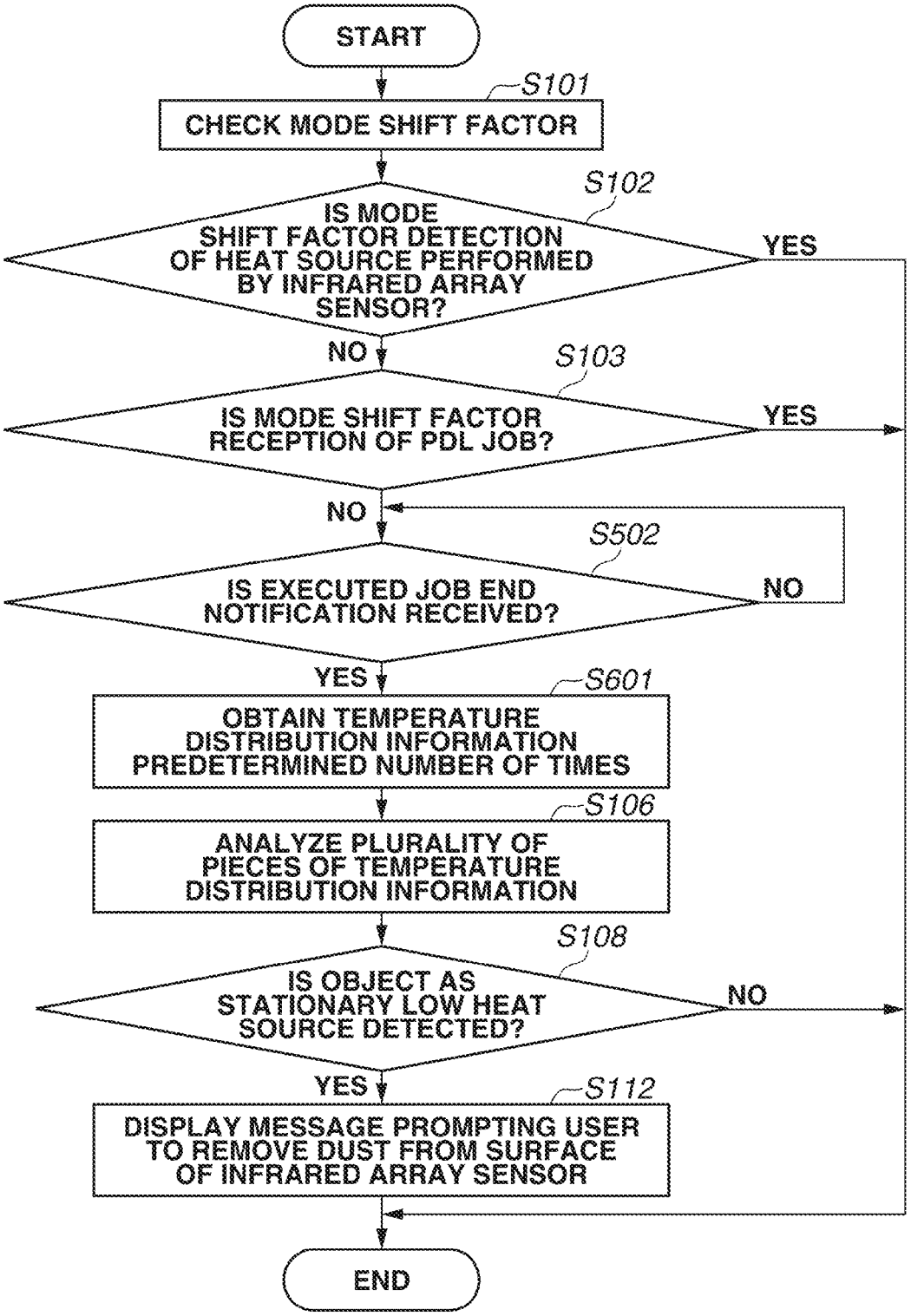
FIG. 14 is a flowchart illustrating an example of dust detection processing according to a third exemplary embodiment.

FIG. 14 is a flowchart illustrating an example of dust detection processing according to the third exemplary embodiment. The processing of this flowchart is implemented by the sensor unit CPU 101 reading and executing a program stored in the ROM 102. Steps similar to those of FIGS. 7 and 13 are denoted by the same step numbers.

In step S601, the sensor unit CPU 101 performs processing for obtaining temperature distribution information from the infrared arrays sensor 100 a predetermined number of times at predetermined cycles after the end of the job of the image forming apparatus 1000. The sensor unit CPU 101 records the obtained temperature distribution information in the RAM 103. Such processing is performed to record the temperature distribution information in a state where the user has disappeared from the front of the image forming apparatus 1000. The obtaining processing may thus be started when a predetermined time (which can be set, for example, by an administrator) has passed after the end of the executed job.

The infrared array sensor 100 receives light of the heat source of an object closest to the light receiving unit 2100. If the light receiving unit 2100 is blocked by dust and the ambient temperature of the image forming apparatus 1000 is lower than the temperature of the dust, the portion covered with the dust can be a high heat source.

Figure 15A:
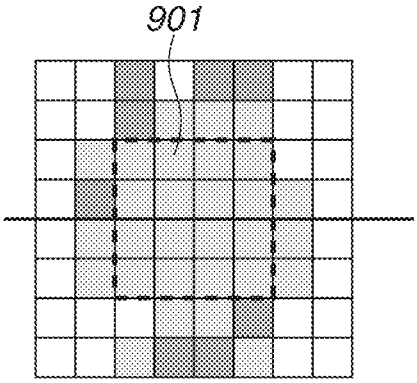
FIGS. 15A, 15B, and 15C are diagrams illustrating examples of temperature distribution information obtained by the sensor unit CPU.
Figure 15B:
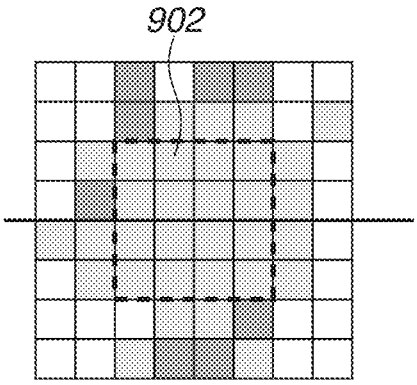
Figure 15C:
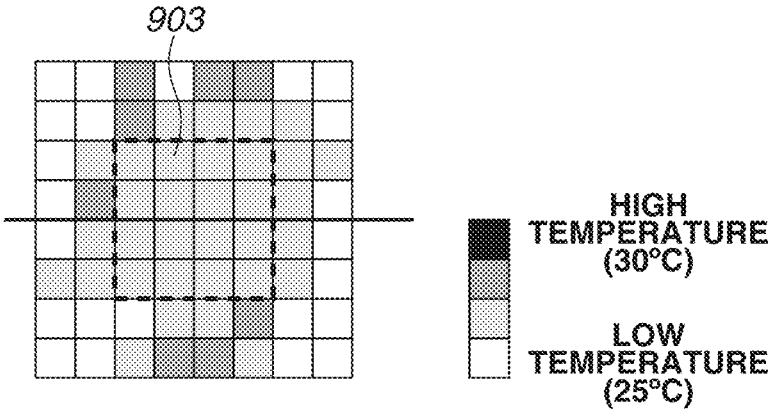

FIGS. 15A to 15C are diagrams illustrating examples of the temperature distribution information obtained by the sensor unit CPU 101 in step S601 of FIG. 14.

FIGS. 15A, 15B, and 15C illustrate temperature distribution information at different times.

When FIGS. 15A, 15B, and 15C are compared, it can be seen that there is an object which is a stationary low heat source within broken-lined areas 901, 902, and 903. However, since the objet which is a stationary low heat source in the area 901 has a temperature lower than that of a heat source (human body), the sensor unit CPU 101 does not determine that the heat source has approached the image forming apparatus 1000. A description of the rest of the processing will be omitted.

In the third exemplary embodiment, the sensor unit CPU 101 is configured to detect dust by obtaining the temperature distribution information after the end of a job of the image forming apparatus 1000. However, the sensor unit CPU 101 may be configured to detect dust by obtaining and recording temperature distribution information when the image forming apparatus 1000 is in the power saving mode. In such a case, the sensor unit CPU 101 is configured to, if the image forming apparatus 1000 recovers to the normal operation power mode next time, skip step S601 of FIG. 14 and perform the analysis in step S106 and the determination in step S108.

Like the first exemplary embodiment, a step of shifting to the temperature distribution difference mode may be added to the third exemplary embodiment.

As described above, according to the third exemplary embodiment, it can be determined that the infrared array sensor 100 of non-light emission type is blocked by dust (dust can be detected), and the user can be notified thereof and prompted to remove the dust.

In an exemplary embodiments of the present invention, the power mode of the image forming apparatus 1000 may shift from the power saving mode to the normal operation power mode for a reason other than the detection and determination using the infrared array sensor 100, such as the pressing of the power saving key 500 (in which case the heat source is near the image forming apparatus 1000). In such a case, temperature distribution information obtained from the infrared array sensor 100 at different times is analyzed, and if a stationary low heat source is detected, a notification is issued to remove dust from the infrared array sensor 100. In this configuration, even with the infrared array sensor 100 of non-light emission type, it can be determined whether there is dust adhering to the infrared array sensor 100, and it becomes possible to prompt the user to remove the dust and maintain a state where the infrared array sensor 100 functions effectively. Further, only portions of the infrared array sensor 100 not affected by the dust can be used to control the image forming apparatus 1000. The image forming apparatus 1000 can thus be normally controlled while detecting the approach of a person by using the infrared array sensor 100.

Other Embodiments

Embodiments of the present invention can also be realized by a computer of a system or apparatus that reads out and executes computer executable instructions recorded on a storage medium (e.g., non-transitory computer-readable storage medium) to perform the functions of one or more of the above-described embodiment(s) of the present invention, and by a method performed by the computer of the system or apparatus by, for example, reading out and executing the computer executable instructions from the storage medium to perform the functions of one or more of the above-described embodiment(s). The computer may comprise one or more of a central processing unit (CPU), micro processing unit (MPU), or other circuitry, and may include a network of separate computers or separate computer processors. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-131142, filed Jun. 26, 2014, which is hereby incorporated by reference herein in its entirety.

What is claimed is:

1. An image forming apparatus having a first power state and a second power state in which power consumption is lower than in the first power state, the imaging forming apparatus comprising:

a detection unit configured to detect an object present in a vicinity of the image forming apparatus;

a receiving unit configured to receive a user's operation;

a control unit configured to, if the object is detected by the detection unit or if the receiving unit receives the user's operation, shift the image forming apparatus from the second power state to the first power state; and a display unit configured to, if the image forming apparatus is shifted from the second power state to the first power state in response to receipt of the user's operation by the receiving unit, display information indicating that there is dust adhering to the detection unit.

2. The image forming apparatus according to claim 1, wherein the display unit is configured to display the information indicating that there is dust adhering to the detection unit based on history information about temperature detected by the detection unit.

3. The image forming apparatus according to claim 2, further comprising a determination unit configured to determine whether there is dust adhering to the detection unit based on the history information about the temperature detected by the detection unit.

4. The image forming apparatus according to claim 3, wherein the history information is obtained while the image forming apparatus shifted to the first power state in response to the receipt of the user's operation by the receiving unit is executing a job.

5. The image forming apparatus according to claim 3, wherein the history information is obtained before and after the image forming apparatus shifted to the first power state in response to the receipt of the user's operation by the receiving unit executes a job.

6. The image forming apparatus according to claim 3, wherein the history information is obtained after the image forming apparatus shifted to the first power state in response to the receipt of the user's operation by the receiving unit executes a job.

7. The image forming apparatus according to claim 3, wherein the determination unit is configured to, if the temperature indicated by the history information remains unchanged, determine that there is dust adhering to the detection unit.

8. The image forming apparatus according to claim 1, wherein the detection unit is a sensor including a plurality of elements for detecting temperature of the object.

9. The image forming apparatus according to claim 8, wherein the elements are infrared light receiving elements.

10. A method for controlling an image forming apparatus having a first power state and a second power state in which power consumption is lower than in the first power state, the method comprising:

detecting an object present in a vicinity of the image forming apparatus by a detection unit;

receiving a user's operation;

if the object is detected or if the user's operation is received, shifting the image forming apparatus from the second power state to the first power state; and if the image forming apparatus is shifted from the second power state to the first power state in response to the receipt of the user's operation, displaying information indicating that there is dust adhering to the detection unit.

11. The method for controlling an image forming apparatus according to claim 10, wherein the display unit is configured to display information showing that there is dust adhering to the detection unit based on history information about temperature detected by the detection unit.

12. The method for controlling an image forming apparatus according to claim 10, further comprising determining whether there is dust adhering to the detection unit based on history information about temperature detected by the detection unit.

13. The method for controlling an image forming apparatus according to claim 12, further comprising obtaining the history information while the image forming apparatus shifted to the first power state in response to the receipt of the user's operation is executing a job.

14. The method for controlling an image forming apparatus according to claim 12, further comprising obtaining the history information before and after the image forming apparatus shifted to the first power state in response to the receipt of the user's operation executes a job.

15. The method for controlling an image forming apparatus according to claim 12, further comprising obtaining the history information after the image forming apparatus shifted to the first power state in response to the receipt of the user's operation executes a job.

16. The method for controlling an image forming apparatus according to claim 12, wherein the determining unit is configured to, if the temperature indicated by the history information remains unchanged, determine that there is dust adhering to the detection unit.

17. The method for controlling an image forming apparatus according to claim 10, wherein the detection unit is a sensor including a plurality of elements for detecting temperature of the object.

18. The method for controlling an image forming apparatus according to claim 17, wherein the elements are infrared light receiving elements.

* * * * *